US010532333B2

(12) United States Patent
Merchant et al.

(10) Patent No.: US 10,532,333 B2
(45) Date of Patent: Jan. 14, 2020

(54) DEVICE FOR MIXING, STIRRING AND PREPARING A HOMOGENEOUS MIXTURE OF LIQUID PRODUCT

(71) Applicants: Courtenay Merchant, Wroughton Wiltshire (GB); Philip Allinson-James, Swindon Wiltshire (GB)

(72) Inventors: Courtenay Merchant, Wroughton Wiltshire (GB); Philip Allinson-James, Swindon Wiltshire (GB)

(73) Assignee: DARCOURTS LTD, Gloucester (GB)

( * ) Notice: Subject to any disclaimer, the term of this patent is extended or adjusted under 35 U.S.C. 154(b) by 66 days.

(21) Appl. No.: 15/737,860

(22) PCT Filed: Mar. 7, 2016

(86) PCT No.: PCT/GB2016/050627

§ 371 (c)(1),
(2) Date: Dec. 19, 2017

(87) PCT Pub. No.: WO2016/156786

PCT Pub. Date: Oct. 6, 2016

(65) Prior Publication Data

US 2019/0001286 A1 Jan. 3, 2019

(30) Foreign Application Priority Data

Jun. 19, 2015 (GB) ..... 1510811.1

(51) Int. Cl.

| | |
|---|---|
| ***B01F 13/00*** | (2006.01) |
| ***B01F 7/00*** | (2006.01) |
| *B44D 3/06* | (2006.01) |

(52) U.S. Cl.

CPC ..... *B01F 13/0028* (2013.01); *B01F 7/001* (2013.01); *B01F 7/003* (2013.01); *B44D 3/06* (2013.01)

(58) Field of Classification Search

CPC ..... B01F 13/0028; B01F 7/001; B01F 7/003; B01F 7/00091; B01F 7/00583; B44D 3/06

USPC ..... 366/343

See application file for complete search history.

(56) References Cited

U.S. PATENT DOCUMENTS

| | | | |
|---|---|---|---|
| 2,799,485 | A | 7/1957 | Silverman |
| 2,879,044 | A | 3/1959 | Gunas |
| 4,083,653 | A | 4/1978 | Stiffler |
| 4,422,770 | A | 12/1983 | Geible |

(Continued)

FOREIGN PATENT DOCUMENTS

| | | | |
|---|---|---|---|
| GB | 459932 | | 4/1935 |
| GB | 2444922 | A | 6/2008 |

(Continued)

*Primary Examiner* — Marc C Howell

(74) *Attorney, Agent, or Firm* — Jacob M. Ward; Ward Law Office LLC

(57) ABSTRACT

The present invention describes a rotating mixing/stirring device that includes a shaft (1) connectable to a rotational drive element, the rotating shaft (1) having sufficient length to accommodate at least one integral, substantially orthogonal blade or impeller (5). The blade or impeller (5) is driven to rotate by the rotating shaft (1) and thereby mix and stir any liquid in which the device is used. The blade or impeller (5) includes a plurality of apertures (6) arranged perpendicular to the rotating shaft (1) and these apertures are tapered.

8 Claims, 3 Drawing Sheets

(56) References Cited

U.S. PATENT DOCUMENTS

| | | | | | |
|---|---|---|---|---|---|
| 4,859,073 | A * | 8/1989 | Howseman, Jr. | B01F 7/003 | 366/195 |
| 4,936,688 | A * | 6/1990 | Cornell | B01F 7/003 | 219/432 |
| 5,073,033 | A * | 12/1991 | Klepeis | B01F 7/001 | 366/129 |
| 5,090,816 | A | 2/1992 | Socha | | |
| 5,368,388 | A | 11/1994 | Fillon | | |
| 6,902,315 | B2 | 6/2005 | Hutchinson | | |
| 7,607,820 | B2 | 10/2009 | Krzywdziak | | |
| 2009/0141586 | A1 | 6/2009 | Dyer, III | | |
| 2011/0249529 | A1 * | 10/2011 | Hirzel | B01F 7/00058 | 366/343 |
| 2011/0317511 | A1 | 12/2011 | Dobay | | |

FOREIGN PATENT DOCUMENTS

| | | | |
|---|---|---|---|
| GB | 2466705 | A | 7/2010 |
| GB | 2501264 | A | 10/2013 |

* cited by examiner

DEVICE FOR MIXING, STIRRING AND PREPARING A HOMOGENEOUS MIXTURE OF LIQUID PRODUCT

CROSS-REFERENCE TO RELATED APPLICATIONS

This patent application is a United States National Stage of International Patent Application No. PCT/GB2016/050627, filed Mar. 7, 2016, which in turn claims the benefit of Great Britain Patent Application No. GB1510811.1, filed Jun. 19, 2015. The entire disclosures of the above patent applications are hereby incorporated herein by reference.

TECHNICAL FIELD

The present invention relates generally to the field of mixing, stirring and preparing a homogeneous mixture of liquid materials. More particularly the invention is applied in the field of preparing materials such as plasters, paints and other liquid finishes, used in painting and decorating the internal and exterior surfaces of buildings.

No matter how well such liquids and materials are mixed before sale to the customer, whilst they sit on a shelf either during distribution or even after purchase, they will always settle and colours can and do separate. This is a particular problem with modern paints, which are becoming more and more complex with popular colours sometimes being variations of many tones. Furthermore, sometimes a user will need to finish a day's work with a part tin of paint left and wants to be able to mix it again the next day with the same intensity to achieve perfect colour match.

BACKGROUND ART

Where small volumes of paint or other finishes have required re-mixing, it is well known for a user to achieve this by manually stirring the mixture with a stick or spatula. Where such mixing or stirring is more arduous, it has long been suggested that such manual stirring and mixing may be more efficiently achieved by a device utilising an electric motor, see for example PTL 0001: GB 11010/35 (GEORG CAULTER). 1935 Apr. 9.

Published Document

PTL 0002: U.S. Pat. No. 2,799,485 (ISAAC SILVERMAN). 1957 Jul. 16.

describes an attachment that can be fitted in the chuck of an ordinary electric hand drill to mix or stir the contents of a paint can or other container. The attachment is formed from an elongated shaft having a mixing blade attached to its lower end and an extension stem, which projects below the mixing blade to space the blade away from the bottom of the container. The problem with this type of device is that although rotation of the elongated shaft and mixing blade is driven by an electric drill, the sweep of the mixing blade is significantly less than the diameter of the container and therefore the user still has to move the attachment around in the container contents manually to ensure everything is mixed adequately. This requires some degree of effort and skill to hold and manoeuvre the drill and mixing attachment, while stirring to mix components which have become stratified, with heavy components typically sinking to the bottom of the container in a thick sludge like manner.

To overcome this problem,

PTL 0003: U.S. Pat. No. 4,083,653 (HUGH A. STIFFLER). 1978 Apr. 11.

suggests a stirring device that employs a shaft-mounted hub with five axially nested, radially extendable fins shaped to provide both compact nesting of the five fins and also to provide ample surface area when extended for stirring. However, this device is complex, as is the mode of operation described in the document and it is difficult to clean effectively. Although holes are shown distributed along the fins in FIGS. 3 and 4, this document specifically teaches away from the formation of a vortex during stirring (see column 3, lines 16 to 17).

In another example,

PTL 0004: U.S. Pat. No. 4,422,770 (GEIBLE HARRY F). 1983 Dec. 27.

describes a paint stirrer, which is attached to a second lid assembly. The second lid assembly comprises a lid to prevent splashes during use and a stirring rod which projects through the lid and may be driven by an electric drill. The stirring rod has a bottom portion which is sized and shaped to lie close to the peripheral and the bottom walls of the container before terminating at the centre of the internal volume thereof, to ensure complete stirring of the paint within the container, without any requirement for the user to manually manoeuvre the drill around in the paint to ensure complete mixing.

PTL 0005: U.S. Pat. No. 5,090,816 (THOMAS SOCHA). 1992 Feb. 25.

describes yet another mixing device having a rotatable impeller with multiple blades. Each blade of the impeller has an optimal angle of attack with respect to the fluid being mixed and each blade has an aperture (or elliptical hole) for an improved flow stream of fluid through the aperture upon mixing. Again, this device is difficult to clean and package as the impeller blades extend radially outwardly from the rotatable shaft. The blades are arranged at a particular angle of attack with respect to the fluid and the shaft axis.

Finally,

PTL 0006: US 2009/0141586 A (DYER, III). 2009 Jun. 4.

describes yet another mixing rod having attached blades of the propeller or impeller type that are elongated flat-plate, curved or contoured, and have arched projections so that the material to be blended or mixed can flow through (i.e. under the arch) when the blades are rotated. Optionally, the blades also have apertures or holes, which when present are located under or otherwise adjacent to the arched projections. As described above, this device is difficult to clean and package as the impeller blades extend radially outward from the shaft.

SUMMARY OF INVENTION

The present invention provides a mixing/stirring device that overcomes the disadvantages of the mixer/stirrers described above as well as surpassing the performance of devices currently available in the market. Current devices are either too flimsy, arduous and inefficient for the purpose of the present invention or are too heavy for a user to handle effectively and not cause damage to the container. The mixing device according to the invention has proved both efficient and long-lasting for mixing paints (internal and masonry paint), creosote, varnishes, PVA and even bitumen. However, the invention also has potential application for products involving the mixing of powders into liquids, such as plaster, grout, tile cement and adhesives (wallpaper paste) for example. The mixing device according to the invention is solid, sturdy, simple, incredibly efficient, safe and easy to use. Also, as the device is arranged solely in one plane, it is easy to clean and package in a simple envelope package, which is easy to display on a hanging rail or hook. However, most importantly, in a short space of time the invention provides an excellently mixed end product.

The rotating mixing/stirring device of the present invention, includes a shaft connectable to a rotational drive element, the rotating shaft having sufficient length to accommodate at least one integral, substantially orthogonal blade or impeller. The blade or impeller is driven to rotate by the rotating shaft and thereby mix and stir any liquid in which the device is used. The blade or impeller includes a plurality of apertures extending through the blade or impeller and arranged perpendicular to the rotating shaft and preferably one or more of these apertures are tapered. The rotation, creates drag forces both above and below the blade or impeller and these drag forces lead to cavitation behind the blade or impeller. Furthermore, the integral tapered apertures increase the velocity of liquid passing through the tapered apertures, which causes a cyclone effect moving the liquid to be mixed through this combination of forces again and again.

The blade or impeller is preferably positioned at the free end of the rotating shaft, at the end opposite to the drive element. It is preferable to leave a space between the free end of the rotating blade or impeller and the base of the container in which the liquid to be mixed is located. This ensures that the rotation of the blade or impeller is unimpeded by the container allowing it to continue rotating freely. Preferably, the rotating shaft has a loop at one end and the blade or impeller is fixed to the rotating shaft across this loop. In this arrangement, the lower part of the loop (that extends below the blade or impeller) acts as a suitable spacing element between the blade or impeller and the base of the container. Furthermore, this part of the loop may have a curved bevelled section, which allows the blade or impeller to rotate freely as previously described, but also ensures that no separated settled liquid remains at the bottom of the container un-agitated. This curved bevelled section also ensures that there is no damage to the base of the container even when contact occurs between the lower part of the loop and the base of the container during rotation of the device.

Furthermore, the mixing/stirring device may be provided as a single piece with rounded edges on the sides of the blade or impeller. This ensures ease of use, safety and strength and allows for the rotating mixing/stirring device to intermittently connect with the interior structure of the container holding the liquid to be stirred or mixed without causing internal damage to the container, unlike the propeller style mixing blades described in the background art.

The rotating mixing/stirring device may be made from any material strong enough to withstand the pressures endured during the mixing process. As such, this will to some extent dependent upon the viscosity of the liquid product which is being mixed. However, most preferably the mixing/stirring device is made from stainless steel, which as well as providing the necessary strength for most applications, reduces corrosion and is also easy to clean.

BRIEF DESCRIPTION OF DRAWINGS

The invention will now be described in more detail, by way of example only, with reference to the accompanying drawings in which

Referring to FIG. 1, the rotating mixing device consists of a rotating shaft 1 at the base of which is a loop 2 and across the centre of the loop is a blade or impeller 5 fixed substantially orthogonal to the rotating shaft 1. The loop 2 forms the free end of the rotating shaft 1. The blade or impeller 5 has a plurality of tapered apertures 6 arranged along its length that are tapered on opposing sides of the blade or impeller 5. At the base of the blade or impeller 5, the lower half of the loop has a curved or bevelled edge 3.

If the container (not shown) is wider than the width of the impeller 5, the rotating mixing device of the invention can be easily moved around within the container to help evenly mix liquid products of greater viscosity without causing damage to the container. The lower half of the loop with bevelled edge 3 can remain in contact (resting) on the base of the container even whilst the mixing device is being moved around and this makes the device particularly useful for those people who do not have sufficient strength to support the weight of the rotational drive element.

Figure 1:
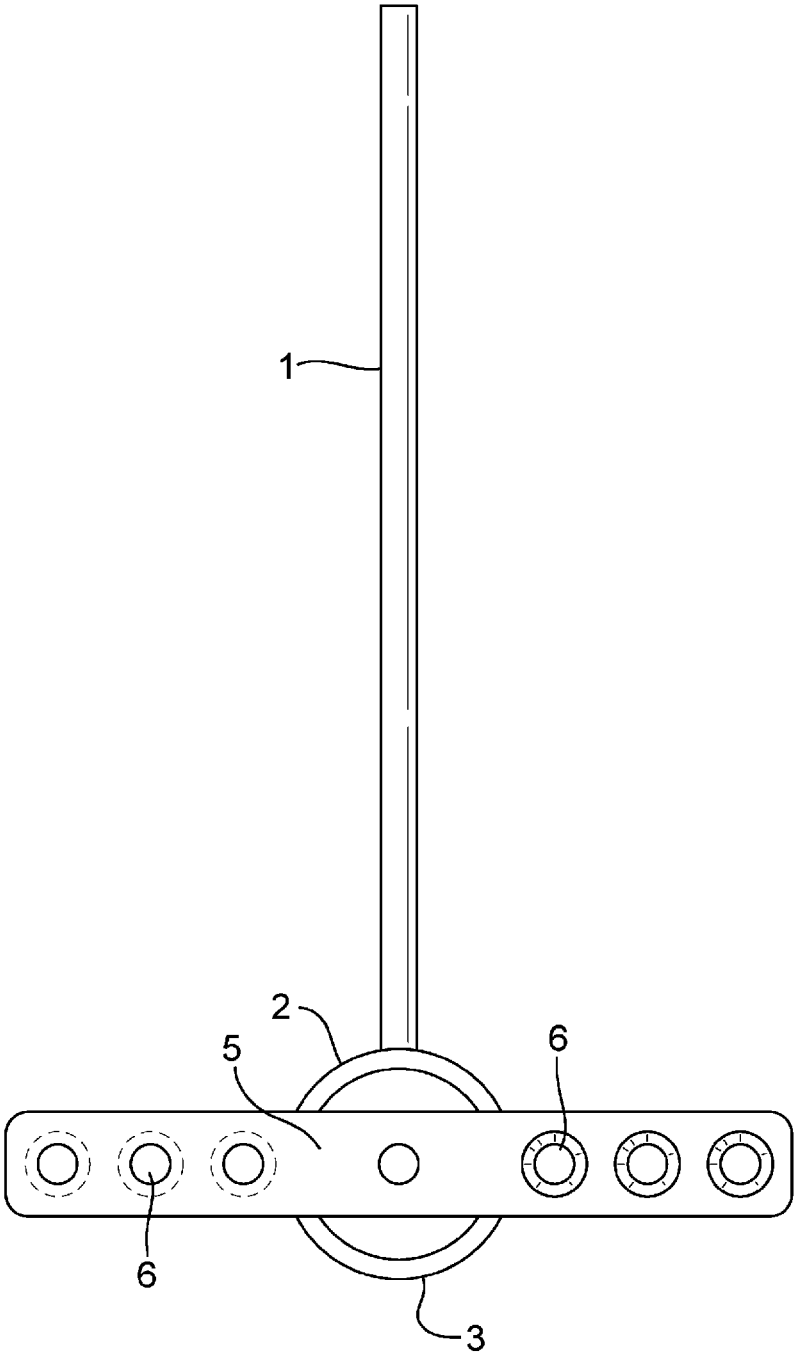
FIG. 1 shows a front view of the mixing device, comprising a main rotating shaft leading to an orthogonal impeller with integrated tapered apertures.
Figure 2:
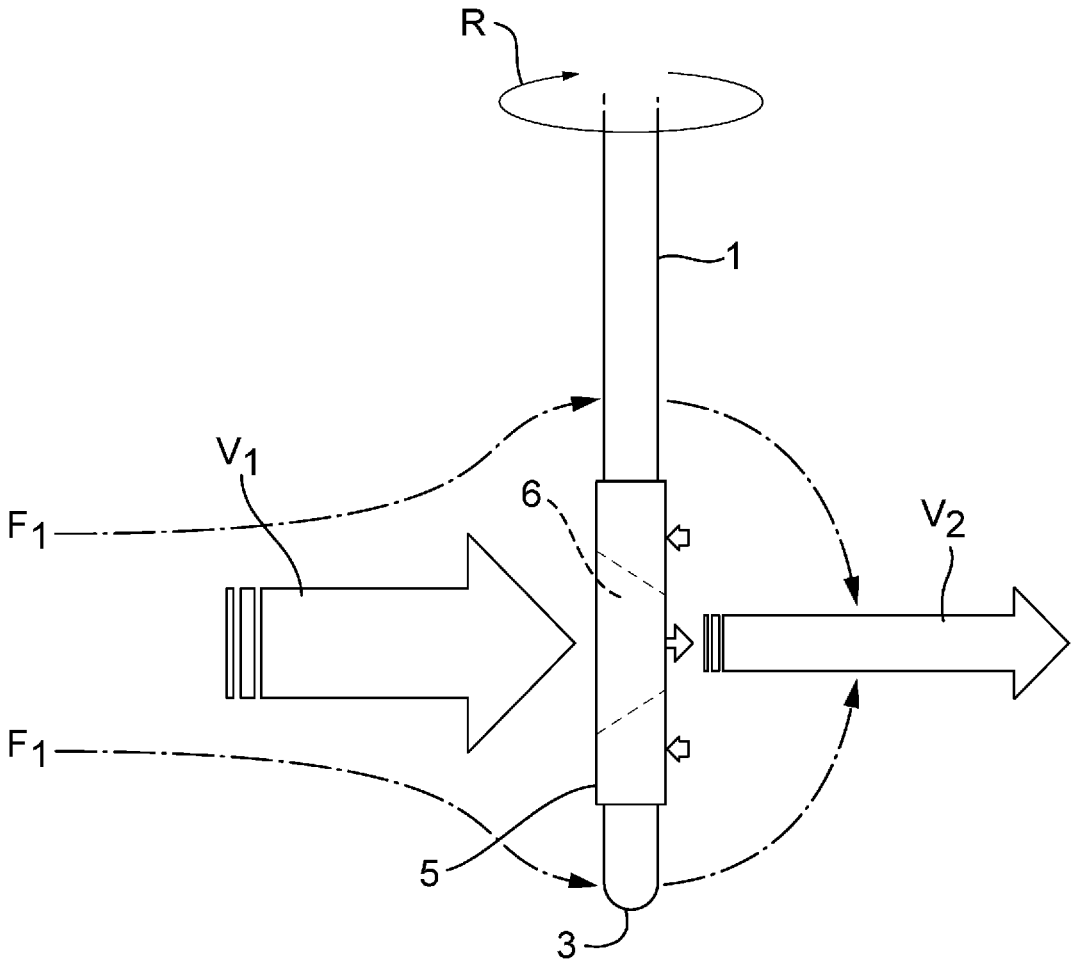
FIG. 2 shows a side view the mixing device shown in FIG. 1, indicating the forces imposed on the product to be mixed by the impeller during rotation of the mixing device and subsequent mixing of the liquid product.

In use, as shown in FIG. 2, the impeller 5 of the mixing device rotates through the liquid and drag forces $F_1$ cause the liquid to pass above and below the impeller 5 and the pressure and drag force exerted on the liquid and solids entrained therein cause cavitation behind the impeller 5 bringing the liquid and solids together with force and thereby mixing the product. At the same time the liquid is also being forced through the tapered holes 6 in the impeller 5 and the rotation of the mixing device causes the incompressible liquid forced through the tapered holes to increase in velocity from $V_1$ to $V_2$. The combination of drag force, cavitation and increased velocity exerted on the liquid allows for a thorough mixing process regardless of the viscosity of the liquid product.

As part of the mixing process, when the lower part of the bevelled loop 3 lying below the impeller 5, rests against the base of the container of liquid product to be mixed and is rotated, the subsequent forces agitate any settled or separated liquid or solid components and incorporates them into the mixture whilst the bevelled loop 3 keeps the impeller 5 above the base of the container (not shown) allowing the impeller 5 to rotate freely, without colliding with or scraping the bottom of the container. The contact between the base of the loop and the bottom of the container is enhanced by the bevelled edge of the loop 3, which forms the contact surface with the bottom of the container and thereby prevents damage even during rotation of the device.

Figure 3:
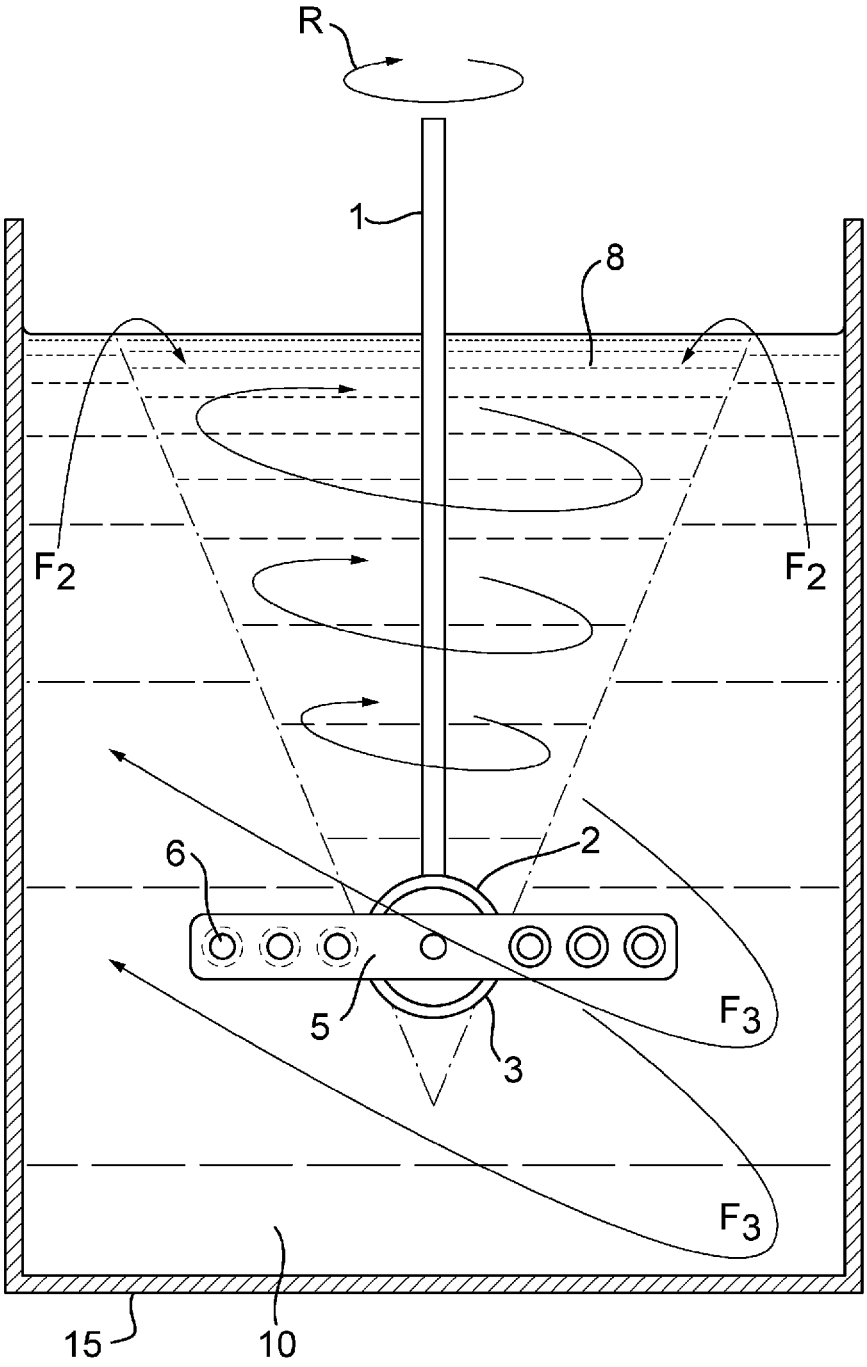
FIG. 3 shows the front view of the mixing device shown in FIG. 1 inserted into a container of liquid product, indicating the forces created during operation of the mixing device and the subsequent fluid motion of the liquid as it passes through the impeller and creates a swirling, cyclonic motion of the liquid product within the container.

Finally, FIG. 3 shows the further forces occurring during operation of the mixing device of the present invention. The rotation of the impeller 5 of the mixing device creates a cyclone effect 8 on the liquid product 10 in the container 15 drawing the liquid from the top of the vessel $F_2$ to the bottom as it naturally moves from high-pressure to low-pressure and subsequently through the collision of molecules forces the mixed liquid 10 back up the sides of the container $F_3$ before bringing it down again $F_2$ to create the cyclone effect 8. This circulating or swirling motion of the liquid product 10 repeats to effect the mixing process over and over again until the user is satisfied with the mixture.

In order to appreciate the benefits and ease of use of the device according to the invention for a user, the applicants hereby describe its simple operating instructions. Upon first use, the user simply removes the device from its fold over, envelope style package which is discarded and preferably recycled. One end of the blade or impeller may then be used to open the container, making the use of a separate screwdriver for this task redundant.

The end of the shaft opposite to the blade or impeller is inserted into the chuck of a conventional drill (preferably a variable speed drill) as far as possible, and then the chuck is tightened as usual. Without starting the drill, the mixing device is lowered into the centre of the fluid or liquid until the loop at the free end of the shaft rests on the base of the container. Whilst holding the container, the user simply starts the rotation of the drill at low speed (if possible) in a clockwise direction building up the rotation speed until the entire mixture is in motion and a cyclone effect is observed. This speed is maintained until the liquid product is thoroughly mixed. For use with thicker products or products in larger containers, the mixing device may require moving around the container to ensure that all the liquid product has been through the mixing process.

Once the user is happy with the mixture, the drill may be stopped, whilst keeping the mixing device submerged within the liquid. Once the rotation has stopped, the mixing device may be removed from the liquid, whilst removing any excess product from the mixing device when holding it over the container. Once removed from the drill, the mixing device is simply cleaned by submerging it in a recommended cleaning agent, or solvent. For some applications, a user may also want to scrub the mixing device or wipe it with a cloth during the cleaning process, and this is made simpler by the mixing device according to the invention, because it is arranged solely in one plane and can therefore be laid on a flat surface before scrubbing or wiping with a cloth.

The reason that a variable speed drill is preferred, is because starting the mixing device at high-speed within the container may cause splashes or spills of product from the container. Also, rotation of the mixing device before inserting it into the product to be mixed or immediately after removing it from the container and whilst still covered in the mixed product will cause splattering of splashes of product.

Although not explicitly disclosed, the person skilled in the art will easily be able to modify the design of the impeller 5 and/or tapered holes 6 therein as required to effect successful mixing of liquids of different viscosities and constituent parts.

The invention claimed is:

1. A mixing device, comprising:

a longitudinal shaft having a first end and a second end, a loop with an inner surface and an outer surface, and at least one elongated blade or impeller, the first end connectable to a rotational drive mechanism, the second end attached to the outer surface of the loop, the elongated blade or impeller mounted across the loop, leaving a bottom portion of the loop exposed to provide a spacing element configured to rest against a base of a container of liquid product and to agitate any settled or separated liquid or solid components while also maintaining the elongated blade or impeller above the base of the container, thereby allowing the elongated blade or impeller to rotate freely without colliding with or scraping the base of the container, wherein the elongated blade or impeller has a plurality of tapered apertures arranged along its length and the tapered apertures extend through the blade or impeller and are tapered on opposing sides of the blade or impeller.

2. The mixing device according to claim 1, wherein the blade or impeller has rounded edges on its sides.

3. The mixing device according to claim 1, wherein the bottom portion of the loop is beveled.

4. The mixing device according to claim 1, wherein the longitudinal shaft and the blade or impeller is made from a material strong enough to withstand pressures endured during a mixing process.

5. The mixing device according to claim 4, wherein the longitudinal shaft and the blade or impeller are made from stainless steel.

6. The mixing device according to claim 1, wherein the longitudinal shaft and the loop are arranged to lie in the same plane.

7. The mixing device according to claim 1, wherein the rotational drive mechanism is a variable speed drill.

8. The mixing device according to claim 1, wherein the mixing device is configured to be placed into the container of the liquid product and upon rotation of the longitudinal shaft and elongated blade or impeller, the liquid product is forced through the tapered apertures increasing its velocity, inducing drag forces around the elongated blade or impeller and inducing circulating forces which produce a cyclone effect.

* * * * *